United States Patent [19]

Ennis

[11] 4,327,525

[45] May 4, 1982

[54] SERVICING ATTACHMENT FOR A CARDING MACHINE

[75] Inventor: Brian J. Ennis, Sowerby Bridge, England

[73] Assignee: The English Card Clothing Company Limited, Huddersfield, England

[21] Appl. No.: 18,936

[22] Filed: Mar. 9, 1979

[51] Int. Cl.[3] ..... B24B 19/18; D01G 15/80

[52] U.S. Cl. ..... 51/242

[58] Field of Search ..... 51/242, 243

[56] References Cited

FOREIGN PATENT DOCUMENTS

| | | | |
|---|---|---|---|
| 2317609 | 10/1974 | Fed. Rep. of Germany | 51/242 |
| 513903 | 2/1955 | Italy | 51/242 |
| 11196 | of 1897 | United Kingdom | 51/242 |
| 679033 | 9/1952 | United Kingdom | 51/242 |

*Primary Examiner*—Roscoe V. Parker
*Attorney, Agent, or Firm*—Norris & Bateman

[57] ABSTRACT

An improved servicing attachment, for occasional use on a carding machine, having a support beam traversing a roller of the carding machine and removably mounted on the carding machine, a traversing unit reciprocably mounted on the support beam and a motor on the beam for moving the unit, a motor and driven spindle on the unit, a grinder or fettler on the spindle for treating the card clothing on the roller of the carding machine, support structure including stub axle supports on the beam mating with bearings on the carding machine which are aligned with the axis of the traversing unit driven spindle so that there are a range of angles about the axis of the spindle at which the attachment can be oriented without altering the setting between the grinder or fettler and the roller being treated, and handles on the beam ends for lifting the servicing attachment onto and off of the carding machine being serviced.

6 Claims, 8 Drawing Figures

—FIG.1—

Figure 1:
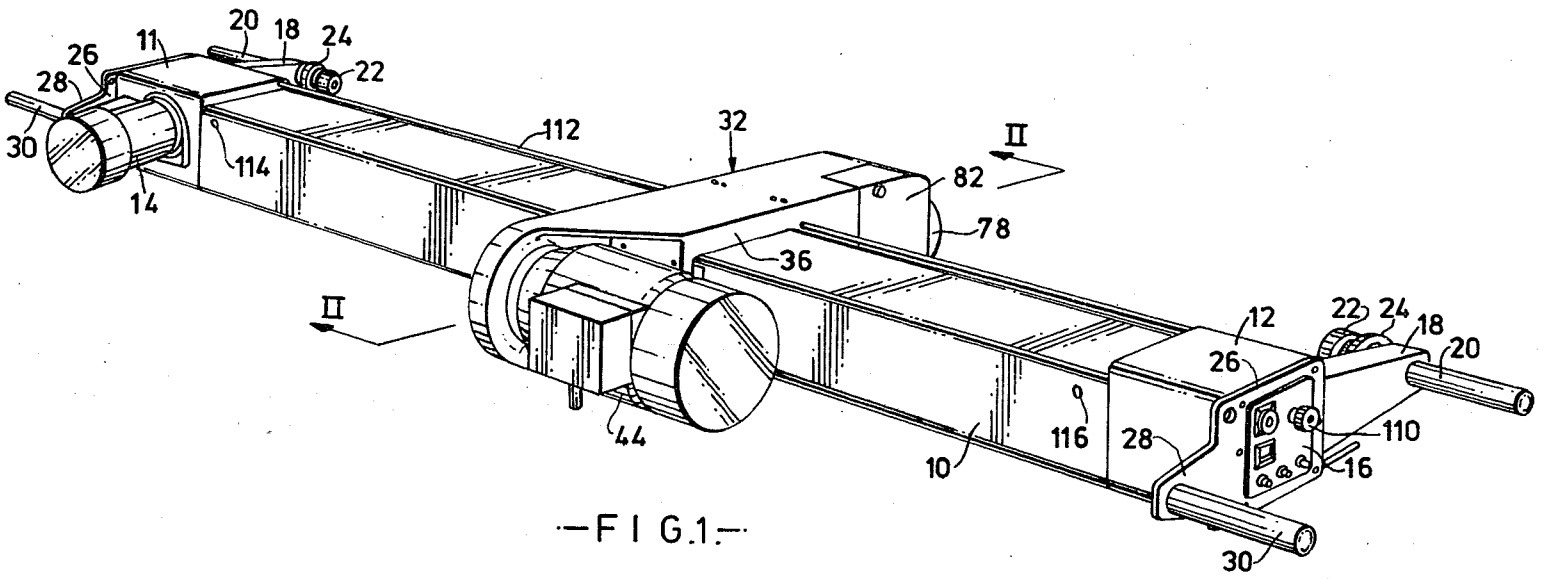

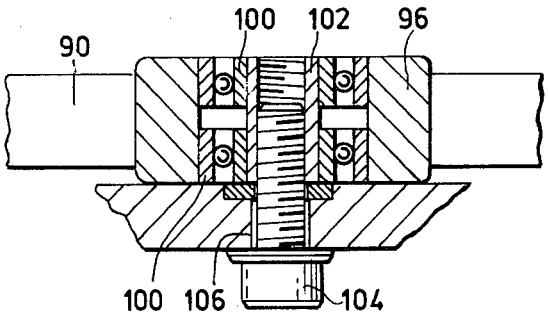
-FIG.4.-
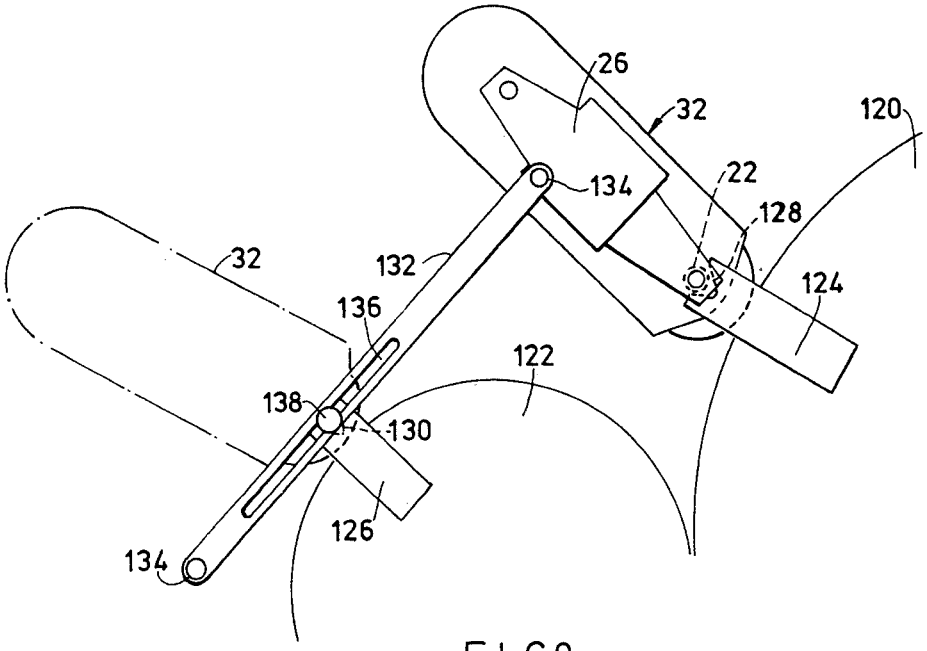
-FIG.8.-

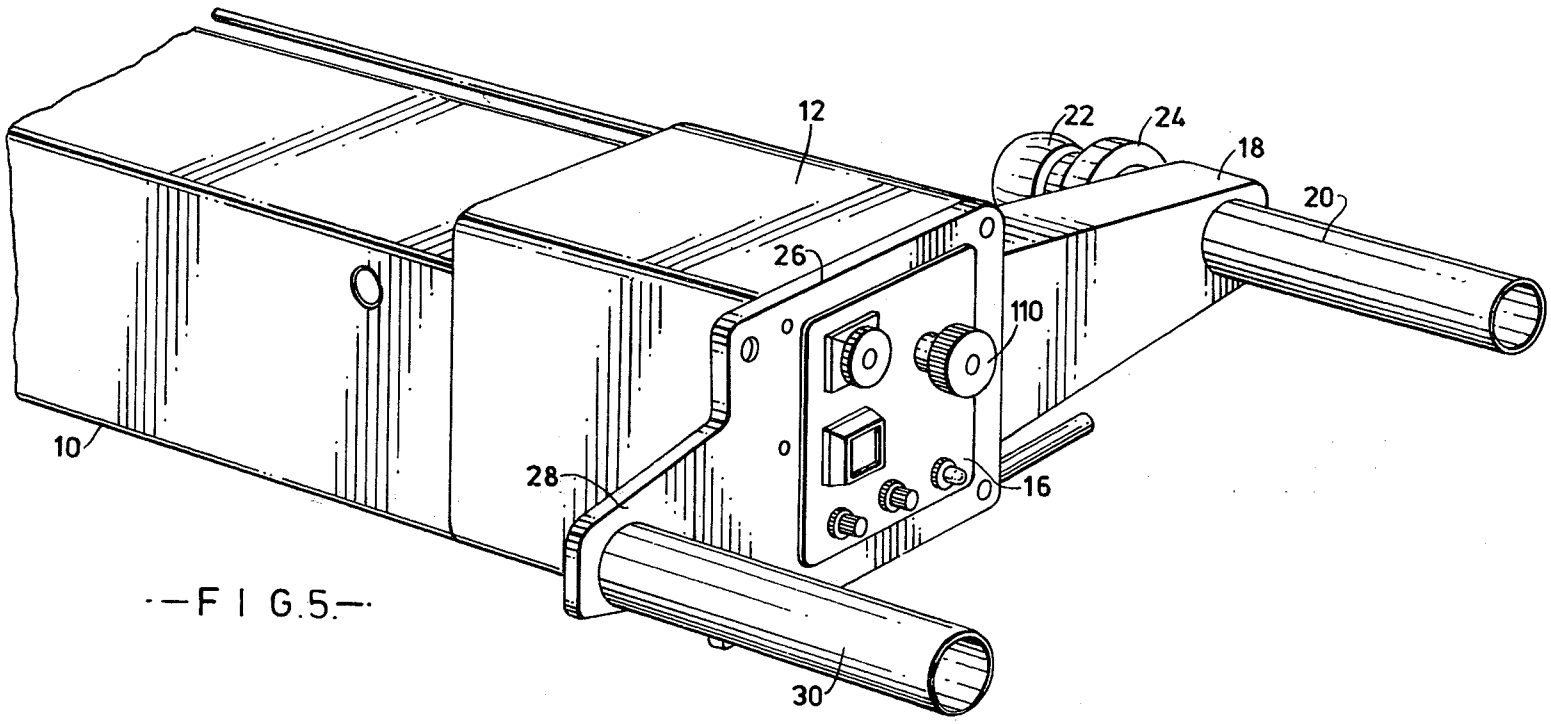
—FIG.5—

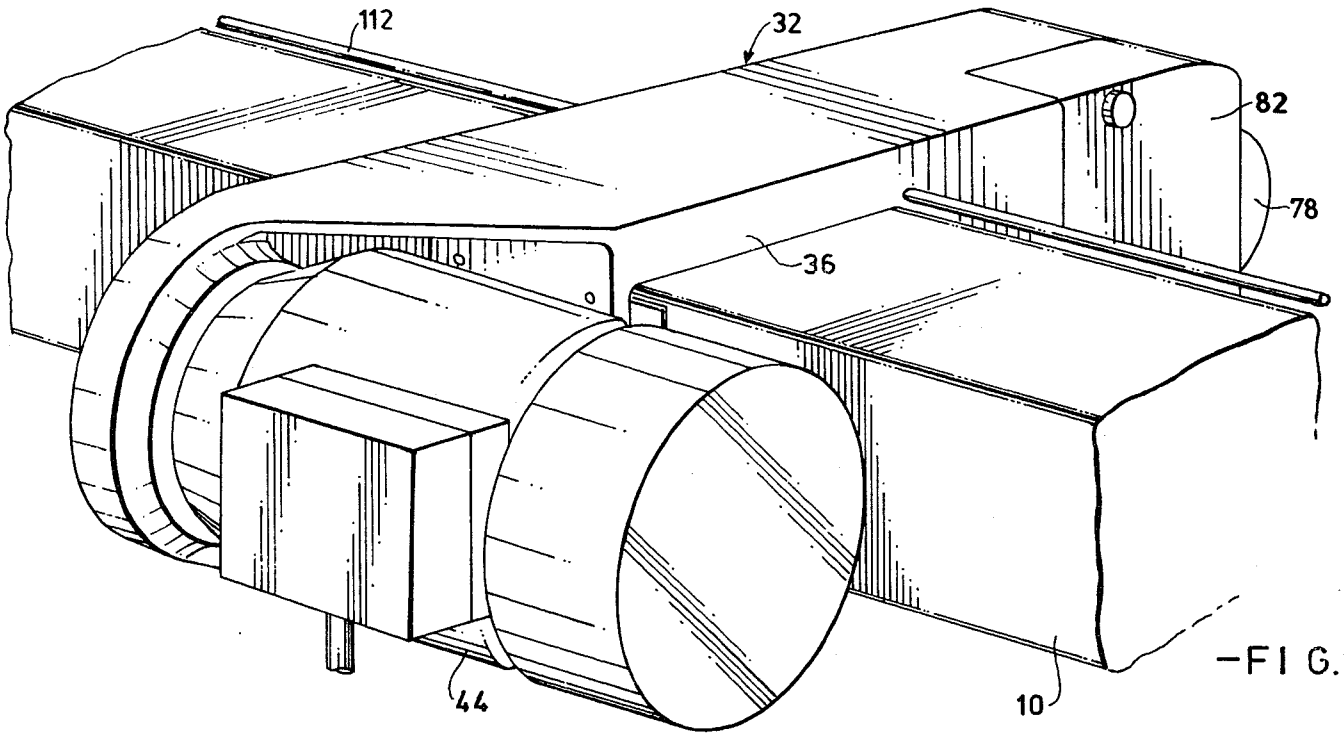
-FIG. 6-

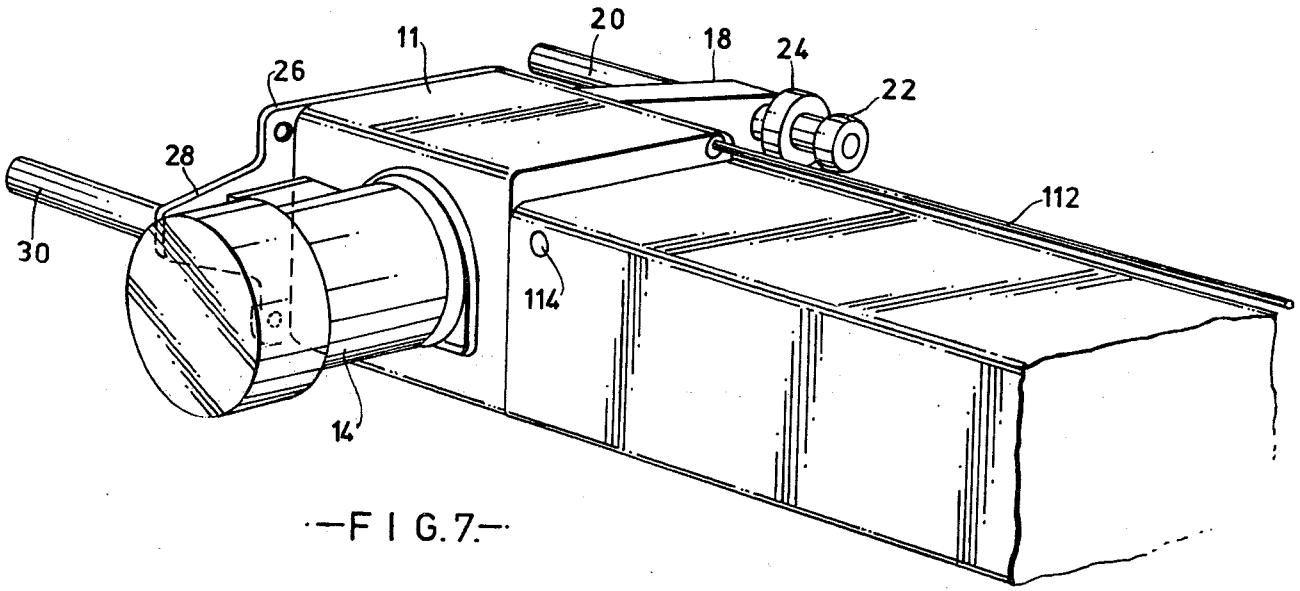
—FIG. 7.—

SERVICING ATTACHMENT FOR A CARDING MACHINE

The present invention is concerned with a servicing attachment for occasional use on a carding machine, which includes a rotary device which co-operates with a roller of the machine to improve the performance of that roller. One such servicing attachment is a grinder for grinding the teeth of card-clothing on the roller, and another is a fettler, which has a rotary brush or comb for removing fibrous waste and other foreign matter from the card-clothing on the roller.

An attachment of this kind is only fitted to the carding machine when it is required to service one of the machine rollers, and one of the problems associated with the use of such an attachment is that the space available for it on the machine is frequently very limited. An object of the present invention is to provide an attachment which can be readily adjusted when being mounted on the carding machine, even in a confined space.

According to one aspect of this invention a servicing attachment for use on a carding machine, of the type which has a rotary device for co-operation with a roller of the machine, has a longitudinally extending support structure and a traversing unit which itself comprises a carriage mounting a spindle for the rotary device, and a driving motor for the rotary device, the traversing unit being mounted for longitudinal reciprocation on the support structure, there being an arm projecting laterally from each end of the support structure and carrying a stub axle, the two stub axles being coaxial with the axes of the spindle, whereby when the stub axles are located in bearings on a carding machine, adjacent to a roller to be serviced, there is a range of angles about the axis of the spindle at which the attachment can be orientated without altering the setting between the rotary device and the roller to be serviced.

Preferably part spherical bearing surfaces are formed on the stub axles for engagement in socket bearings (which may be parallel sided or part spherical) formed on the carding machine. One or both stub axles may be adjustable longitudinally to permit variation in the distance between the stub axles or between bearing surfaces formed thereon. It is also preferred to provide means for locking each adjustable stub axle in any selected longitudinal position.

According to another preferred feature of the invention the arrangement is such that the traversing unit is entirely supported in respect of its own weight and any applied loads by the support structure.

This invention also relates to a grinding attachment for grinding the card-clothing in situ on the rollers of a carding machine, particularly the swift or cylinder, the doffer and the taker-in.

One well known grinding attachment of this kind employs a grinding wheel, supported on a short sleeve, which is mounted for rotation on a carrier sleeve extending across the width of the machine, the carrier sleeve being slotted through most of its length, and the short grinding wheel sleeve having an internally projecting peg passing through the slot in the longitudinally extending sleeve, into an endless reversed helical groove in a spindle which passes through the longitudinal sleeve and is coaxial therewith. Both the spindle and the longitudinal sleeve are rotated about their common axis, by a driving motor mounted at one end of the grinding attachment, but the driving mechanism is such, that there is a differential between the angular velocity of the sleeve, and that of the spindle, so that the grinding wheel is caused to have a reciprocating traverse along the longitudinal sleeve, in addition to its own rotation. The peripheral speed of the grinding wheel is restricted to a speed lower than that which is desirable for grinding card-clothing—particularly metallic wire card-clothing—because of the mechanical limitations of safely rotating the slotted tube carrying the considerable mass of the traversing grinding head. In a specific example, using a four inch diameter tube, the maximum safe working speed of the grinding wheel is 900 r.p.m., and with a 3 inch diameter tube, this falls to 750 r.p.m. By engineering standards, these speeds are low for grinding, so that the grinding wheel tends to wipe rather than cut the metal being ground. In addition, with this known type of grinding attachment, it is difficult to change the grinding wheel, because one has to dismantle the assembly of the grinding wheel sleeve, longitudinal sleeve and spindle.

It has been proposed to provide a grinding attachment for card-clothing, with a traversing carriage, having both a grinding wheel spindle and a driving motor for the spindle, mounted on the carriage, with a belt drive from the motor to the spindle, and in this proposed arrangement, the traversing carriage is supported by a frame adapted to extend across the carding machine, and comprising two longitudinally extending members, one of which is coaxial with and passes through the grinding wheel spindle. Location of the spindle (and hence the grinding wheel) is provided by the longitudinal member which passes through the spindle, but this member itself is subject to deflection. Now if the said longitudinal member is increased in size, in an attempt to minimise deflection, that reduces the radial thickness of the annular portion of the grinding wheel which is available for useful work. It is not practicable to increase the outside diameter of the grinding wheel beyond a predetermined size, because of the confined spaces which are available on the carding machine for the grinding attachment. Moreover, when it is required to change the grinding wheel, it is still necessary to dismantle the longitudinal member which passes through the grinding wheel spindle, and this is a tedious operation.

The object of the present invention is to provide an improved grinding attachment for use on a carding machine, which has a relatively high degree of accuracy of grinding wheel location during the grinding operation, and which present a reasonable radial thickness of the grinding wheel for useful work. A further object of the invention is to provide a grinding attachment, in which it is relatively easy to carry out a change of the grinding wheel.

According to this invention a grinding attachment for use on a carding machine has a longitudinally extending beam, at least two laterally spaced longitudinally extending guide tracks carried by the beam, and a traversing unit which itself comprises a saddle having bearings engaging respectively on the guide tracks, and mounting a grinding wheel spindle disposed on one side of the beam and a driving motor for the grinding wheel spindle disposed on the opposite side of the beam to the grinding wheel spindle, with an endless flexible drive member connecting the motor to the spindle the flexible drive member having runs extending on opposite sides of the beam, the traversing unit being located by and adapted to slide longitudinally on the tracks, but being entirely supported in respect of its own weight and any applied loads by the beam.

The beam is preferably of substantial cross-section, so that it presents a considerable moment of inertia about any plane perpendicular to loads arising out of the weight of the attachment and loads applied in use. Preferably the cross-section of the beam is such that any deflection arising out of these loads is within acceptable limits having regard to the function of the attachment. For instance in the grinding of card-clothing teeth, a maximum expected deflection in the order of 0.025 millimeters (0.001 inches) would be acceptable.

By virtue of the construction of the attachment it is possible to use a traversing unit which includes both the grinding wheel mounting and the driving motor for the grinding wheel—thereby enabling the driving wheel to be driven at the high speeds required for proper grinding—whilst at the same time obviating the necessity for a guide member passing through the grinding wheel spindle. Hence, one does not have the problems of deflection and grinding wheel changing associated with such a longitudinally extending guide member.

Preferably the guide tracks are provided by a pair of rods of circular cross-section, the first of which is located on the beam by a mounting of V cross-section, and the second being located on the beam by a mounting having a flat surface, whereby there is provision for some movement of the second rod towards and away from the first rod, there being means for clamping the two rods on to their respective mountings. It is further preferred that each of the bearings on the carriage is a recirculating ball-bearing, with the insides of the balls engaging directly on the outsides of the rods.

According to another preferred feature of the invention, the beam is of hollow rectangular cross-section, and in the preferred embodiment of the invention, it is of square cross-section. The two guide tracks are preferably positioned adjacent to opposite edges of one face of the beam and in the preferred construction this is a face normal to the plane containing the axes of the driving motor and the grinding wheel attachment.

Preferably the saddle of the traversing unit is of short length and embraces the beam, a first flange projecting from one side of the saddle supporting the grinding wheel mounting and a second flange projecting from the opposite side of the saddle providing a mounting for the driving motor. The saddle may be tubular, so that it surrounds the beam.

The traversing unit preferably has a driving pulley at the motor side of the saddle and a driven pulley at the grinding wheel spindle side of the saddle, the flexible drive member connecting the two pulleys. Preferably, the driven pulley is of smaller outside diameter than the dimension of the beam perpendicular to the plane passing through the axes of rotation of the motor shaft and the grinding wheel spindle, there being at least one guide pulley for the flexible drive member at the same side of the beam as the grinding wheel mounting, the geometrical arrangement of the pulleys being such that the flexible drive member is held clear of the beam.

In the preferred arrangement there are two guide pulleys arranged on opposite sides of the plane containing the axes of the motorshaft and the grinding wheel spindle, and each spacing a respective run of the flexible drive member from the adjacent side of the beam.

The driving pulley may also be of smaller outside diameter than the said perpendicular dimension of the beam, there being a further guide pulley or pulleys at the motor side of the beam, the geometrical arrangement of the pulleys at that side of the beam taking part in the spacing of the flexible drive member from the beam. In fact, the pulley arrangement at the motor side of the beam may be a "mirror image" of the arrangement at the grinding spindle side of the beam.

The flexible drive member preferably comprises an endless belt.

Figure 2:
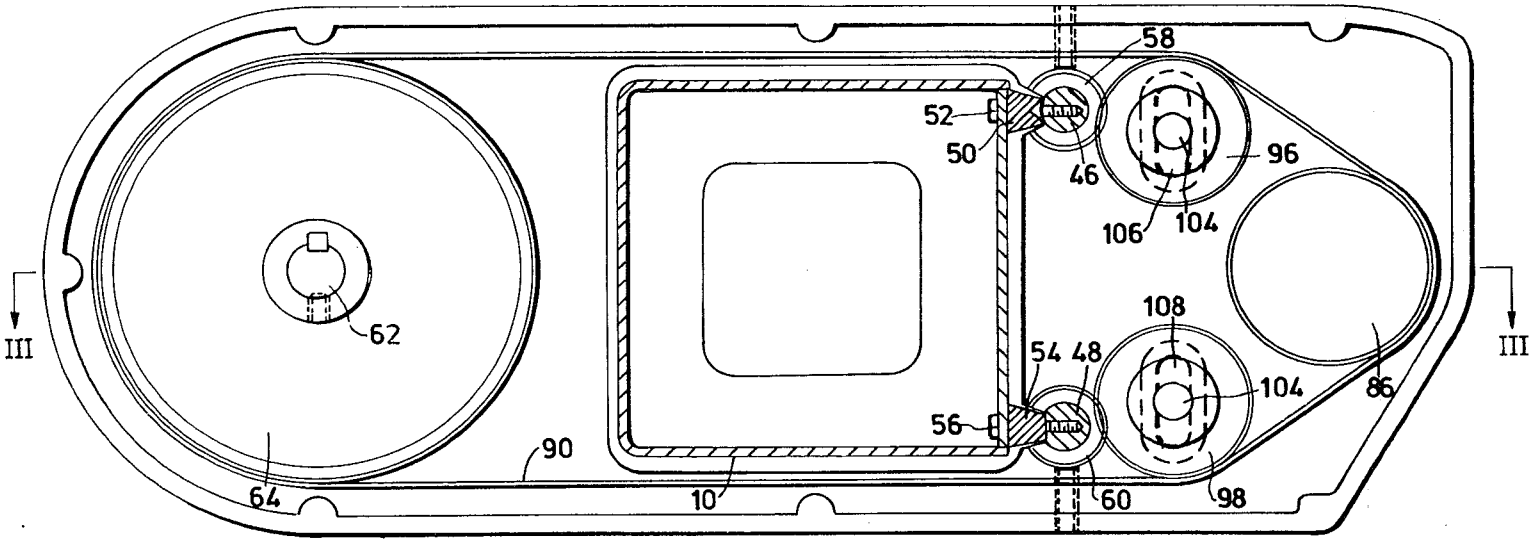
Figure 3:
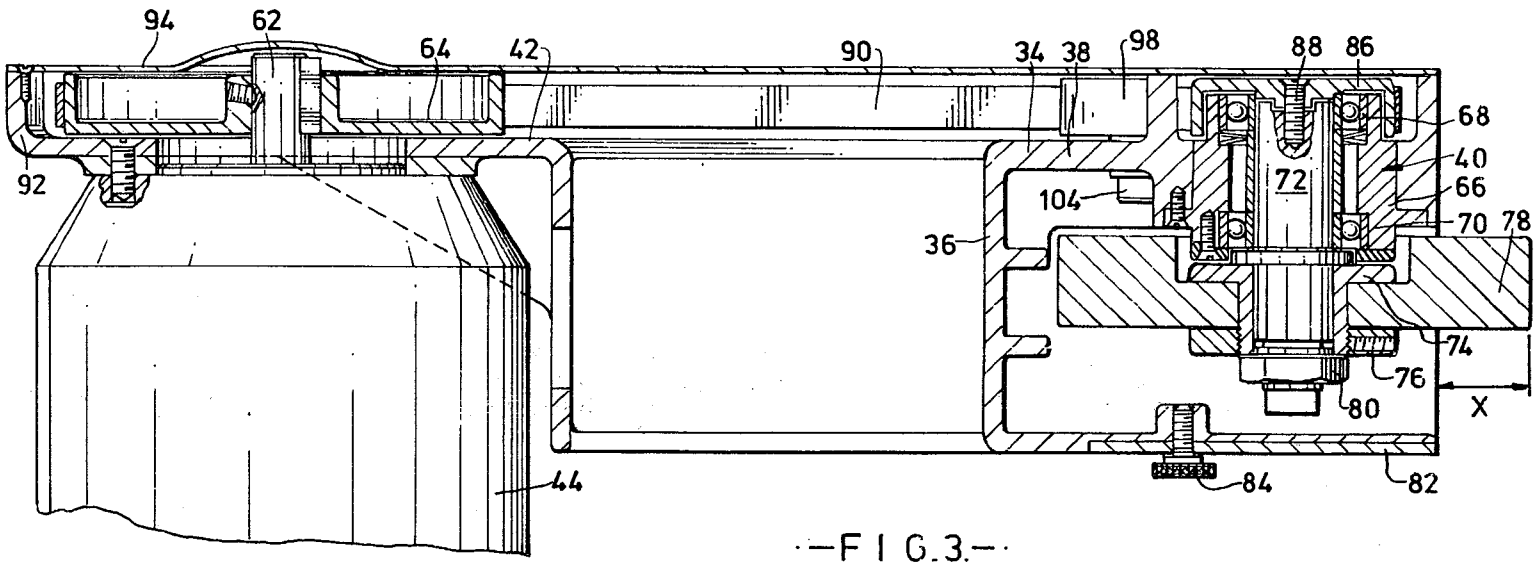

A grinding attachment for use in a carding machine, and constructed in accordance with both aspects of the invention, will now be described by way of examples only, with reference to the accompanying drawings, in which:

FIG. 1 is a perspective view showing the grinding attachment,

FIG. 2 is a cross-section to a larger scale on the the line II—II in FIG. 1, FIG. 3 is a part sectional plan view taken on the line III—III in FIG. 2, FIG. 4 is a section to a larger scale through a guide roller, FIG. 5 is a perspective view to a larger scale of the right hand end of the attachment as seen in FIG. 1, FIG. 6 is a perspective view to a larger scale of the saddle shown in FIG. 1, FIG. 7 is a perspective view to a larger scale of the left hand end of the attachment as seen in FIG. 1, and FIG. 8 is a diagram showing the method of mounting the attachment on a carding machine.

A steel beam 10 of hollow square cross-section extends longitudinally of the attachment, and is of substantial proportions, as it is intended to carry all the applied loads, without deflection of a magnitude to significantly affect the grinding operation. The length of the beam 10 is determined by the width of the carding machines on which the grinding attachment is to be used, since the beam 10 must be of approximately the same length as the width of the principal card-clothed rollers on the carding machine itself. Boxes 11 and 12 of slightly larger cross-section than the beam 10, are secured to opposite ends of the beam, these boxes providing housings for pulleys (not shown) which are used in a traversing mechanism which will hereinafter be described in detail, the box 11 also supporting a small electric motor 14, hereinafter referred to as the traversing motor, and the box 12 carrying a control panel 16. An arm 18 projects forwardly from each of the boxes 11 and 12, there being a tubular stub axle 20 located in each of the arms 18, these stub axles being coaxial with each other. Part of each stub axle 20 projects inwardly from its respective arm 18, and at its inner end, the stub axle is formed with a part spherical seating 22, for reception in a mounting bracket on the carding machine as will be hereinafter described. Between that part spherical seating 22 and the inside face of the arm 18, a knurled nut 24 is fitted on to a screw-threaded portion of the axle 20.

An end plate 26 is secured to and closes the otherwise open end of each of the boxes 11 and 12, and each of these end plates 26 has a rearwardly projecting flange 28, which provides a mounting for a tubular handle 30, which extends outwardly from the plate 26. In addition, the stub axles 20 extend outwardly from their respective arms 18, and there is thus provided a pair of handles 20 and 30, at each end of the grinding attachment, by means of which it is possible to manipulate the attachment when fitting it on to or removing it from the carding machine.

A traversing unit 32 is adapted to reciprocate along the length of the beam 10, between the end boxes 11 and 12, and this unit has a cast metal saddle 34, which includes a short square tubular section 36 (see FIG. 3) which embraces the beam 10, the internal dimensions of the short tubular section 36 being somewhat larger than the external dimensions of the beam 10, so that the saddle 34 is quite free to move endwise on the beam. The saddle 34 also has a forwardly extending flange 38 which provides support for a grinding wheel spindle mounting 40, and there is a rearwardly extending flange 42, which provides a mounting for an electric motor 44, hereinafter referred to as the grinding wheel motor.

For the purpose of supporting and guiding the traversing unit 32 on the beam 10, a pair of guide tracks are provided by cylindrical rods 46 and 48 (see FIG. 2) which are secured to the front face of the beam 10. Near to the upper front edge of the beam 10, there is a mounting strip 50, which is welded to the beam and which extends longitudinally thereof. The front face of the strip 50 is concave in cross-section as illustrated in FIG. 2—although it could be of V shape—and the top guide rod 46 is received within the concave front face of the mounting strip 50. Clearance holes are formed through the front plate of the beam 10, and the strip 50, at spaced apart positions along the length of the beam, and a set-screw 52 passes through each of the holes and engages in a screw-threaded hole in the rod 46. Thus, the guide rod 46 is firmly anchored to the beam 10.

Along the bottom edge of the front face of the beam 10, there is a similar mounting strip 54, but the front face of the strip is flat (i.e. parallel with the front face of the beam 10), and a corresponding flat is formed on the lower guide rod 48. There is a series of fixing screws 56, for securing the rod 48 to the beam 10, but by virtue of the flat face contact between the rod and the mounting strip, it is possible for the rod 48 to be moved towards and away from the rod 46 within the limits determined by the clearance between the holes in the strip 54 and the screws 56, and this enables the two rods to be adjusted during mounting of the traversing unit 32 on the beam, as may be required to provide tracks on which the traversing head 32 can slide.

Recirculating ball-bearings 58 and 60 are mounted on the saddle 34, and are engageable respectively on the guide rods 46 and 48. Each of the recirculating bearings has a cut-away portion to pass over the respective mounting strip 50 or 54 (see FIG. 2) and is therefore of "C" cross-section. Recirculating ball-bearings are well known in themselves, and need not be described in detail. However, for present purposes, it will be noted that these bearings provide a very firm location of the saddle 34, and therefore the entire traversing unit 32 on the guide rods 46 and 48, and the latter are of course themselves firmly supported by the beam 10. Since there is a clearance between the beam 10, and the tubular portion 36 of the saddle 34, the latter is supported entirely by the guide rods 46 and 48. The grinding motor 44 has an output shaft 62, which passes through the flange 42, and a driving pulley 64 is keyed on to the shaft 62, for rotation therewith. The grinding wheel mounting 40 includes a bearing housing 66, carried by the forwardly extending flange 38 of the saddle, and an assembly of two ball or roller bearings 68 and 70 within the housing 66, provides a journal mounting for a grinding wheel spindle 72. The latter extends on the same side of the flange 38 as the tubular portion 36, and is provided with a conventional pair of grinding wheel clamping members 74 and 76. The latter are adapted to be nipped on to a grinding wheel 78 by means of a nut 80, and consequently when it is required to change the grinding wheel 78, it is only necessary to remove the nut 80 and clamping member 76 in a conventional manner. A grinding wheel cover 82 is secured to forward extensions on the tubular portion 36 of the saddle by knurled screws 84, and of course this cover 82 must be removed before it is possible to change the grinding wheel 78.

It will be noted that the grinding wheel spindle 72, being of the normal solid construction, is of a relatively small diameter, and since this is the only part which passes through the centre of the grinding wheel, it is possible to have a relatively large radial thickness of the grinding wheel which is available for use. The radial dimension of the grinding wheel which is capable of being worn away whilst still retaining the effectiveness of the wheel is indicated at "X" in FIG. 3.

A driven pulley 86 is secured to the grinding wheel spindle 72 by means of a setscrew 88, this pulley being arranged on the opposite side of the flange 38 to the grinding wheel 78, and in alignment with the driving pulley 64 on the grinding wheel motor 44. An endless belt 90 connects the two pulleys 64 and 86, for the purpose of transmitting driving motion from the motor 44 to the grinding wheel 78. It will be observed, that the saddle 34 has an outturned flange 92, which effectively provides a housing for the belt drive, there being a plate-like cover 94 for this housing.

Now it will be observed from FIG. 2, that although the driving pulley 64 is of slightly larger outside diameter than the depth of the beam 10, the pulley 86 is considerably smaller in diameter than the depth of the beam 10, and in order to prevent the sections of the belt 90 which pass on opposite sides of the beam 10 from rubbing on the beam, a pair of additional guide rollers 96 and 98 is provided. Each of these rollers is mounted on a pair of ball bearings 100 (see FIG. 4) and these in turn are mounted on a bush 102 which is screw-threaded internally, to receive a set-screw 104. The latter passes through a vertical slot 106 or 108 in the flange 38, and this provides a means of adjusting the vertical position of the guide pulley 96 or 98 as the case may be. These pulleys have to be set, so that the distance between the outermost points on their peripheries is larger than the depth of the beam 10.

In an alternative construction (not shown) each roller bearing may be mounted on an eccentric pin so that by rotating the pin it is possible to obtain the required vertical adjustment of the roller 96 or 98.

In some instances, it may be desirable to provide a 1:1 ratio drive between the motor 44 and the grinding wheel spindle 72. In that case, the pulley 64 will be of the same outside diameter as the pulley 86, and it will then be necessary to provide an additional pair of guide rollers similar to the rollers 96 and 98, but arranged on the flange 42, at the motor side of the beam 10.

By virtue of the drive arrangement, it is possible to use a driven pulley 86 which is considerably smaller than the outside diameter of the grinding wheel 78, and hence this places no limitation on the radial thickness "X" of the grinding wheel which is available for use.

Within the box 11, there is a speed reduction gear fastened to the output end of the traversing motor 14, and the traversing pulley (previously referred to but not shown) at that end of the apparatus is keyed on to the output shaft of the speed reduction gear. The other traversing pulley which is housed within the box 12, is mounted on a bracket (not shown) which is capable of sliding motion on a longitudinal direction within the box 12, there being a screw having a knurled head 110 (FIGS. 1 and 5) for producing sliding movement of the mounting bracket. In this way, it is possible to move the pulley in the box 12 towards and away from the pulley in the box 11. A cable 112 is anchored at one end to the traversing unit 32, passes from there twice round the pulley in the box 11, to give a capstan effect, returns along a path adjacent to the bottom of the beam 10, through clearance holes in the carriage 34, passes around the pulley in the box 12, and then returns along the top to the carriage 34 to which its other end is anchored. When the pulley in the box 12 is moved outwardly to tension the cable 112, the traversing mechanism can be operated, and if the motor 14 is started, it turns the pulley in the box 11, and this pulls the traversing unit 32 through the cable 112 towards the box 11. A proximity switch 114 is mounted in the beam 10 adjacent to the box 11, and when the traversing unit 32 arrives at the box 11 end of its travel, where the grinding wheel 78 would be moving off the end of the card-clothing on the carding machine roller, the proximity switch is actuated by an adjustable actuating plate mounted on the traversing unit, and this causes reversal of the traversing motor 14, so that the unit 32 begins to move in the opposite direction towards the box 12. A similar proximity switch 116 is mounted in the beam at the other end, and when the unit 32 arrives at that end of the beam, the switch 116 is activated and this also reverses the motor 14, causing the unit 32 to travel again towards the box 11. In this way, so long as the apparatus is operational, the unit 32 will be reciprocated along the length of the beam 10. It is possible to vary the stroke length by adjusting the position of the actuating plates.

The method of mounting the grinding attachment in a carding machine will now be described. Referring to FIG. 8, a carding machine cylinder is indicated at 120, and a doffer at 122. Brackets such as those shown at 124 and 126 are provided on the machine frame to receive the grinding attachment. It will be appreciated that the brackets are always provided in pairs arranged one at each side of the machine, so that the grinding attachment can be mounted between the pair of brackets. Each bracket has an open-topped bearing (indicated diagrammatically at 128 and 130 in FIG. 8) within which the axle of the grinding attachment is received.

When the grinding attachment is being fitted on to a carding machine to grind the card-clothing on the cylinder 120, the part spherical seatings 22 are located in the brackets 124, and then the knurled nuts 24 are screwed inwardly, until they press tightly against the outside faces of their respective mounting brackets 124, thereby locating the grinding attachment laterally with respect to the carding machine. It is of course possible to adjust the lateral displacement of the grinding attachment, by slackening one of the nuts 24, and tightening the other.

A stay is provided at each side of the machine, this stay comprising a bar 132 having a hole 134 at each end to receive a pin by which the stay can be connected to one of the end plates 26 of the attachment, and an elongated slot 136 in which is fitted a clamp screw 138 having a cylindrical part which is adapted to fit in one of the bearings 128 and 130 in the brackets 124 and 126 on the carding machine.

When the attachment has been located with its seatings 22 in the brackets 124, one end of each stay is coupled to one end of the attachment by a pin fitted through one of its holes 134 and the clamp screw is adjusted until it seats in the bracket 126 on the machine, at which stage the clamp screw is tightened. The part of the stay between the clamp screw and the attachment then provides a strut supporting the attachment against the gravitational load due to its own weight and forces tending to rotate the attachment when it is in use. It will be appreciated that the angle of inclination of the attachment is adjusted by adjusting the stay with respect to the clamp screw as permitted by the slot 136.

The mounting brackets 124 are then adjusted to bring the grinding wheel 78 into contact with the card-clothing wires on the cylinder 120. The angular disposition of the grinding attachment relatively to the carding roller is immaterial, because even if the angular position is changed, this will have no effect on the contact of the grinding wheel 78 with the card-clothing. The reason for this is that the stub axles 20 are coaxial with the grinding wheel itself and therefore any angular adjustment of the apparatus is about the axis of the grinding wheel spindle. However, the facility for varying the angle is important, because it permits the grinding attachment to be fitted in the restricted space available on the carding machine.

If the attachment is to be used to grind the card-clothing on the doffer, then the seatings 22 are located in the bearings 130 of the brackets 126. One end of the stay is fitted on to the attachment and the clamp screw bearing surface is received in the bracket 124. In this arrangement the stay 132 acts as a tie and the position of the attachment is shown in chain-dotted lines in FIG. 8.

It is customary to employ two stays, one at each end of the grinding attachment, but with the present construction it may be possible to use only one stay at one end of the attachment. This is because any deflection of the attachment under load will only turn the deflected beam end about the axis provided by the stub axles 20 and hence the position of the grinding wheel relatively to the roller which is being ground will not change.

It will be appreciated, that if the invention is to be applied to a fettler, then it is only necessary to replace the grinding wheel spindle and grinding wheel in the arrangement described above, by a rotary comb or brush. If the rotary fettling device is required to rotate at a slower speed than the grinding wheel, then it may be necessary to use a geared motor in place of the motor 44, and a chain or toothed belt drive may be used in place of the flat belt 90 illustrated in FIGS. 2 and 3.

If it is required to grind the bare surfaces of the cylinder or doffer rollers (i.e. before the card-clothing is applied) then the ends of the beam may be supported on the said side frames of the carding machine. To facilitate this, flat bearing surfaces may be machined on the undersides of the boxes 11 and 12, or on the undersides of special brackets (not shown) attached to the boxes 11 and 12.

I claim:

1. A servicing attachment for use on a carding machine, of the type which has a rotary device for cooperation with a roller of the machine, said servicing attachment having a longitudinally extending support structure and a traversing unit which unit itself comprises a carriage, a spindle for the rotary device mounted on said carriage, and a driving motor for the rotary device also mounted on said carriage, means mounting said traversing unit for longitudinal reciprocation on said support structure; an arm projecting laterally from each end of said support structure, a stub axle carried by each said arm, said two stub axles being coaxial with the axis of said spindle, whereby when said stub axles are located in bearings on a carding machine, adjacent to a roller to be serviced, there is a range of angles about the axis of said spindle at which the attachment can be orientated without altering the setting between the rotary device and the roller to be serviced.

2. A servicing attachment as claimed in claim 1, in which the arrangement is such that said traversing unit is entirely supported in respect of its own weight and any applied loads through said support structure.

3. A servicing attachment according to claim 1, wherein said stub axles are axially adjustable to permit lateral adjustment of the attachment relative to a carding machine on which it is mounted.

4. A servicing attachment according to claim 1 further comprising means for removably affixing said servicing machine on a carding machine.

5. A grinding attachment for use on a carding machine comprising a longitudinally extending beam, a pair of laterally spaced longitudinally extending rods of circular cross section, the first of said pair of rods being located on said beam by mounting of V cross section, and the second of said rods being located on said beam by a mounting having a flat surface, whereby there is a provision for some movement of said second rod towards and away from said first rod, there being means for clamping said two rods on to their respective mountings and a traversing unit which itself comprises a saddle having bearings engaging respectively on said two rods, each of said bearings on said carriage being a re-circulating ball-bearing, with the insides of the balls engaged directly on the outsides of said rods, said saddle also mounting a grinding wheel spindle disposed on one side of said beam and a driving motor for the grinding wheel spindle disposed on the opposite side of said beam to said grinding wheel spindle, there being an endless flexible drive member connecting said motor to said spindle, said flexible drive member having runs extending on opposite sides of said beam, said traversing unit being located by and adapted to slide longitudinally on said pair of rods, but being entirely supported in respect to its own weight and any applied loads through said beam, an arm projecting laterally from each end of said beam and a stub axle carried by each said arm and extending longitudinally, whereby said grinding attachment can be mounted by locating said stub axles in bearings on a carding machine frame, there being a longitudinally extending gap between said stub axles within which said traversing unit can reciprocate, so that no part of the stationary structure comprising said beam, said laterally projecting arms and said stub axles passes through said spindle.

6. A grinding attachment for use on a carding machine comprising a longitudinally extending beam, at least two laterally spaced longitudinally extending guide tracks carried by said beam, and a traversing unit which itself comprises a saddle having bearings engaging respectively on said guide tracks, said saddle also mounting a grinding wheel spindle disposed on one side of said beam and a driving motor for the grinding wheel spindle disposed on the opposite side of said beam to said grinding wheel spindle, there being an endless flexible drive member connecting said motor to said spindle, said flexible drive member having runs extending on opposite sides of said beam, said traversing unit being located by and adapted to slide longitudinally on said tracks, but being entirely supported in respect to its own weight and any applied loads through said beam, an arm projecting laterally from each end of said beam and a stub axle carried by each said arm and extending longitudinally, whereby said grinding attachment can be mounted by locating said stub axles in bearings on a carding machine frame, said stub axles being substantially co-axial with the axis of said grinding wheel mounting, whereby when said stub axles are located in bearings on a carding machine, there is a range of angles about the axis of said grinding wheel, at which said grinding attachment can be orientated, without altering the setting between said grinding wheel and the roller to be ground, there being a longitudinally extending gap between said stub axles within which said traversing unit can reciprocate, so that no part of the stationary structure comprising said beam, said laterally projecting arms, and said stub axles passes through said spindle.

* * * * *